US009427991B1

(12) United States Patent
Goyen et al.

(10) Patent No.: US 9,427,991 B1
(45) Date of Patent: Aug. 30, 2016

(54) CONTROLLERS TO ADJUST PRINT SPEED

(71) Applicant: HEWLETT-PACKARD DEVELOPMENT COMPANY, L.P., Houston, TX (US)

(72) Inventors: Todd Goyen, Vancouver, WA (US); Duane A Koehler, Vancouver, WA (US); Matthew A. Shepherd, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/812,605

(22) Filed: Jul. 29, 2015

(51) Int. Cl.
*B41J 23/00* (2006.01)

(52) U.S. Cl.
CPC ..... *B41J 23/00* (2013.01)

(58) Field of Classification Search
CPC B41J 2/04541; B41J 2/04543; B41J 2/0458; B41J 29/38; B41J 29/393
USPC ..... 347/5, 9, 19
See application file for complete search history.

(56) References Cited

U.S. PATENT DOCUMENTS

2013/0093813 A1* 4/2013 Davis et al. ..... B41J 2/0452 347/17
2014/0210894 A1* 7/2014 Koehler et al. ..... B41J 11/42 347/16

* cited by examiner

*Primary Examiner* — Manish S Shah
*Assistant Examiner* — Roger W Pisha, II
(74) *Attorney, Agent, or Firm* — HP Inc Patent Department

(57) ABSTRACT

An example device in accordance with an aspect of the present disclosure includes a controller to adjust print speed intra-page according to a response curve to substantially track a power curve of a power supply. The controller is to maximize print speed based on short-term energy data corresponding to present and future print data and long-term energy data corresponding to past print data, without exceeding a peak power output and a thermal limit of the power supply when printing according to the response curve.

12 Claims, 10 Drawing Sheets

CONTROLLERS TO ADJUST PRINT SPEED

BACKGROUND

A power supply of a device can be sized to support potential loads set to their maximum value with maximum time correlation. This can result in a very large and expensive power supply, capable of supporting pathologically large, unmanaged, corner-case loads continuously. Although such large power supplies do not need power management, their large capacity may result in inefficiencies under most operational conditions where the device encounters a fraction of its maximum load rating.

BRIEF DESCRIPTION OF THE DRAWINGS/FIGURES

DETAILED DESCRIPTION

Figure 1:
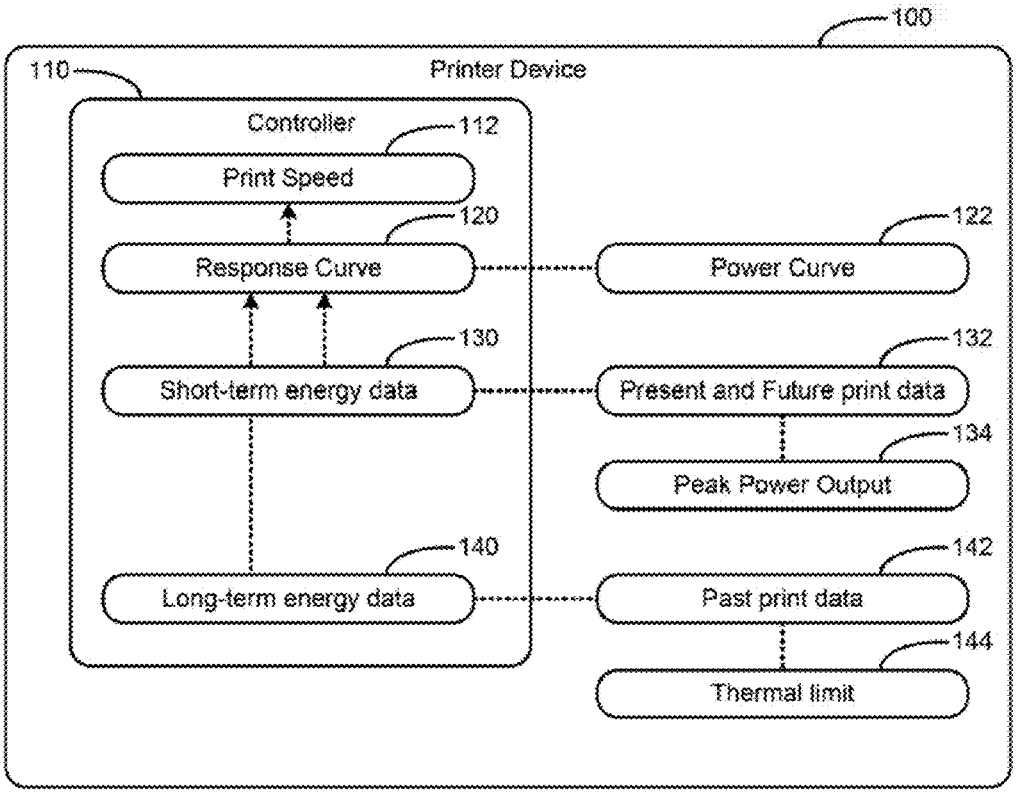
FIG. 1 is a block diagram of a printer device including a controller according to an example.

When printing long jobs (e.g., greater than a few pages of printing), a printer power supply risks using excessive power and damage to the power supply, due to the power supply heating up over time and becoming less efficient. In practice, a time between cut sheet print jobs allows for some cooling of the power supply. However, with continuous print jobs (e.g., roll or z-fold print media), the cooling period may not occur, resulting in a need to limit print speed to prevent the power supply from exceeding its design limits. A large capacity power supply can be used, but likely will spend a large majority of time operating inefficiently at a small fraction of its maximum load rating. Further, large capacity power supplies likely need power factor correction (PFC) circuits (further reducing switching efficiency) and large circuit components (transformers, transistors, bulk capacitors, diodes) that are expensive and consume a large carbon footprint.

To address such issues, examples described herein may selectively increase and decrease a print speed of a printer device intra-page according to a response curve, to cause printer power consumption over time to substantially track a power curve corresponding to a power output of a power supply. Thus, examples can maximize print speed without exceeding a peak power output and/or thermal limit of the power supply when printing according to the response curve. In this manner, examples described herein may use delivered ink data to adjust printer speed, allowing for smaller, more efficient power supplies while taking into account previous printer behavior and predicted future behavior, as well as acting on intra-page time scales to handle transients within a page (e.g., stripes of light and heavy print data). Further, examples can address power supplies having a plurality of power rails, e.g., to address a plurality of print heads dividing the total output of a power supply.

An example power supply may be associated with operating characteristics that are a function of time (e.g., capable of outputting 120 Watts for 1 second, 60 Watts for 1 hour, and so on), due to heating of the power supply or other time-based effects. If operated above this limit, issues can arise such as blown fuses, overheating, etc., that can lead to a failure of the system. The power supply can be associated with a power curve that varies with time, based on the output characteristics of the power supply during operation. Examples described herein can use one or more digital filters to provide a frequency response curve that tracks, i.e., closely or exactly matches, the actual power response curve of the power supply. Example approaches can adjust system print speeds to saturate the power response curve to maximize printer speeds without substantially exceeding the power response curve in a manner (e.g., for an extended time or magnitude) that might harm the power supply or printer. Thus, printer performance can match the actual power response capability of a printer power supply. The filter response curve can be dynamically created to mirror the power supply response curve by using the energy/printer data received at the printer (e.g., in the form of pixel data). A printer controller can generate and use a feedback loop to raise or lower the print speed dynamically intra-page, to operate the printer at or slightly below the power supply's maximum allowed power response curve. Thus, the printer can be operated at the maximum, safely allowable print speed for a given power supply that is sized efficiently and affordably for a given printer.

As used herein, printer devices and printer systems include scanning inkjet printers, page-wide array printers, 3D printers, and other technology. For example, printers can include one or more printheads, such as a page-wide array printer including an array of printheads that span a print media and/or a single printhead that spans the print media. 3D printing may include the deposition of consumable fluids or other consumable materials in a layer-wise additive manufacturing process. Consumables include consumable materials used, such as inks, powders, and so on. Printing on media can include covering a layer of powder-based build material.

FIG. 1 is a block diagram of a printer device 100 including a controller 110 according to an example. The controller 110 is to selectively increase and decrease a print speed 112 of the printer device 100 intra-page according to a response curve 120. This enables printer power consumption over time to substantially track a power curve 122 corresponding to a power output of a power supply (not shown in FIG. 1; see FIG. 2). The controller 110 is to selectively increase and decrease the print speed 112 to maximize the print speed 112 based on short-term energy data 130 corresponding to present and future print data 132 without exceeding a peak power output 134 of the power supply when printing according to the response curve 120. The controller 110 also is to selectively increase and decrease the print speed 112 to maximize the print speed 112 based on long-term energy data 140 corresponding to past print data 142 without exceeding a thermal limit 144 of the power supply when printing according to the response curve 120.

The printer device 100 is to provide page-wide array printing. Accordingly, instead of moving/scanning a print head along a swath across a page, the printer device 100 can print using a fixed array of print head nozzles (not shown) that are stationary relative to the printer device 100, by moving the paper across the print head(s). Thus, the entire width of the page of the printer device 100 can serve as a swath, and the paper is advanced along that swath to provide relative movement between the print heads and paper for printing. In an example printer device 100, the page-wide array printing swath, based on relative motion between print heads and the paper, is on the order of 11 inches wide and can extend thousands of feet long or longer (e.g., by virtue of continuous feed printing using roll-fed media).

Printing by the printer device 100 can continue for minutes, hours, or longer during continuous feed printing. Roll-fed media does not involve cut sheet pages, and so does not provide a timing break between pages every few seconds during which the printer device 100 could have an opportunity to rest the power supply and perform a health check on the print heads. Furthermore, continuous feed printing does not use an input tray holding a finite number of pages that enables the printer to stop and rest during refills of the input tray.

Accordingly, the printer device 100 can be printing for long sustained periods, and the controller 110 can adjust and maximize the print speed 112, while avoiding issues such as overheating of the power supply in view of the extended printing and variations in print data density over time. The controller 110 can interpret data and perform adjustments continuously, avoiding inefficiencies that might arise based on using a discrete integer value print speed limit threshold. The controller 110 can identify the past print data 142, and the present and future print data 132, to identify how long a print job is, and for example slowly adjust the print speed 112 performance over time in a least invasive/limiting manner according to the response curve 120, to cause the power consumption of the printer to track and/or stay under the power curve 122 and prevent overheating of the power supply. Because the controller 110 can track the power curve 122 without needlessly slowing or pausing the printer device 100, the controller 110 is able to maximize print speed 112 and saturate the power curve 122, making the most of a given power supply while protecting it from overheating, even in demanding and lengthy continuous feed printing jobs using roll-fed media. The controller 110 does not need to pause printing in short bursts on a page-by-page basis to analyze/assess print data. Rather, the controller 110 can continuously analyze past/present/future print data 132, 142 in real-time on the fly while printing, and directly measure present power consumption (e.g., via a current meter and/or voltage meter) to ensure that printing demands remain within the power curve 122 and/or any other regulated specifications of the power supply (such as a peak power output 134 and/or thermal limit 144).

Generally, the controller 110 can adjust the print speed 112 to affect how much power is needed from a power supply, because the total energy needed during a print is fixed, and the power used varies directly with the print speed (and/or print quality and density of ink coverage used). The controller 110 can monitor a power supply error (e.g., how far the power supply is operating from its limit, based on a difference between the power curve 122 and the response curve 120), which can be fed back into determining the print speed 112 to ensure the power supply is being utilized at its maximum operating level. In an example, the controller 110 may use a modified/enhanced proportional-integral-derivative (PID) approach, which includes multiple enhancements. In general, a PID approach may include a proportional value (corresponding to a present error), an integral value (corresponding to an accumulation of past errors), and a derivative value (corresponding to a prediction of future errors based on a current rate of change). The enhanced PID approach of the present examples can include damping added to the response curve 120, to address and/or prevent potential undershooting of the power curve 122 (e.g., if the power used temporarily exceeds but is approaching the limit of the power curve 122). The enhanced PID approach also can include, in addition to the general PID terms, a second derivative (e.g., PIDD; see element 226 of FIG. 2) that the controller 110 can track to determine whether print speed control according to the response curve 120 has stabilized under the optimal power curve 122. Such stabilization is likely to occur when printing a large number of similar print data (e.g. printing repetitive labels). If the second derivative stabilizes, then the controller 110 can turn off feedback control, and use a direct solution instead. Although traditional PID controllers may attempt to use an integral term to address such issues, use of the integral term typically leads to a small oscillation of the output (in this case print speed 112), which can cause undesired print quality issues and a poor user experience. Accordingly, the enhanced PID approaches described above can avoid undesired oscillations of the print speed, and the associated undesirable audio effects caused by repetitive oscillating print speed.

The enhanced PID approach used by the controller 110 can include two operational regimes, to consider 1) the past print data 142 and its effect on heating the power supply regarding a thermal limit 144, and 2) the present and future print data 132 to instantaneously ensure the power supply doesn't exceed the peak power output 134 by an excessive amount of time or magnitude. The controller 110 can then identify an appropriate print speed 112, based on the current print speed 112, the power that will be accumulated if the current print speed 112 is maintained, and by looking ahead at the future print data and how much ink/printing density will be involved. For example, the controller 110 can slow down the current print speed 112, to avoid speed oscillations and reduce the temperature of the power supply in view of an upcoming high-density region to be printed. Thus, the controller 110 can adjust the print speed 112 by slowing down or speeding up intra-page, based on multiple regimes to ensure a good user experience by avoiding speed oscillations and attempting to reach a steady state constant print speed associated with improved acoustics while maximizing print speed 112 and avoiding exceeding the capacity of the power supply.

The short-term energy data 130 and long-term energy data 140 are used by the controller 110 to generate the response curve 120, which is used to control the print speed 112. The short-term energy data 130 and long-term energy data 140 can be obtained from pixel data corresponding to past, present, and future print data 132, 142. For example, the controller 110 can refer to a densitometer to identify how many ink dots are fired, and correlate the amount of energy needed to fire each dot based on known calibration of the printer device 100. Such information, along with a turn-on energy of a print head pen, can be stored in identification bits in the pen of the print head of the printer device 100. The controller 110 thus can identify a profile of power needed over time for an arbitrary length of print data to predict needed power/energy data regarding the response curve 120 and power curve 122. The controller 110 also can directly measure based on a current sensor (not shown) in the printer device 100, such as a sense resistor to measure a voltage drop continuously to enable the controller 110 to develop a continuous time profile of power use measured in real time.

The controller 110 can increase or decrease the print speed 112 intra-page, according to closed-loop control. Furthermore, the controller 110 can adjust and/or adapt the print speed 112 during a pass along the swath of the printer device 100, unlike conventional printers that do not perform adjustments during a print head pass along a swath of the print head. The controller 110 also can perform small incremental adjustments to the print speed 112, e.g., one inch-per-second (IPS) changes in speed to avoid print quality (PQ) issues that may be associated with abrupt (e.g., 10 IPS and greater) changes in the print speed 112.

Intra-page adjustments to the print speed 112 can include adjustments made at increments smaller than a page. For example, a standard page length for an A4 printer is 11.7 inches. Thus, intra-page can include adjustments made when the print media advances along the swath of the printer device 100 for less than the length of a standard page for that printer device 100. In addition to making adjustments to the print speed 112, the controller 110 also can affect power consumption by changing a drop count/density of the printing, which may affect PQ if aggressive reduction in drop counts are made.

Figure 2:
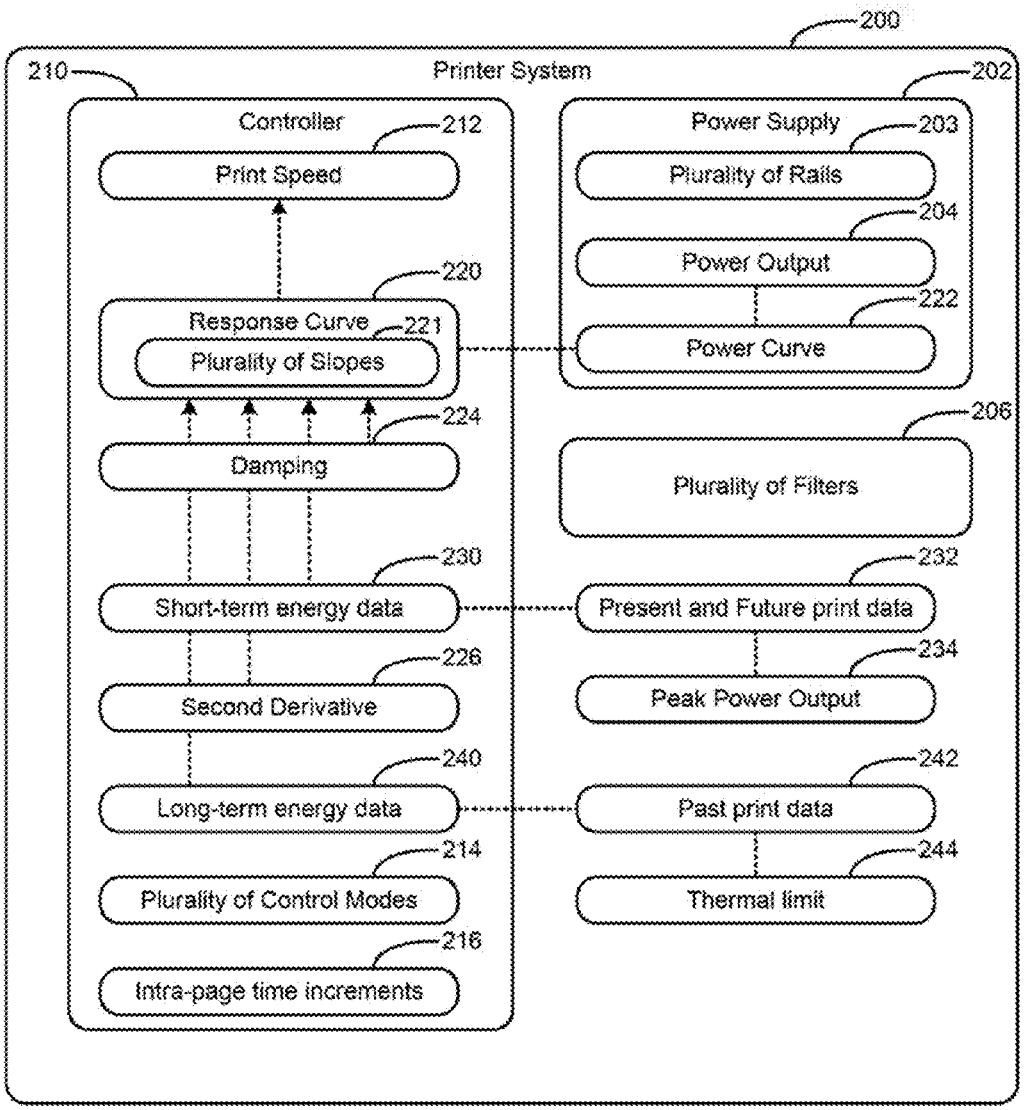
FIG. 2 is a block diagram of a printer system ncluding a controller and a power supply according to an example.

FIG. 2 is a block diagram of a printer system 200 including a controller 210 and a power supply 202 according to an exampie. The power supply 202 is associated with a power curve 222, a plurality of rails 203, and a power output 204 that varies over time according to performance of the power supply 202. The controller 210 is to generate the power curve 222 associated with the power supply 202, based on the power output 204 over time. The controller 210 can selectively increase and decrease the print speed 212 of the printer system intra-page according to a response curve 220, to cause printer power consumption over time to substantially track the power curve 222. The controller is to selectively increase and, decrease the print speed 212 to maximize print speed 212 based on short-term energy data 230 corresponding to present and future print data 232, without exceeding a peak power output 234 of the power supply 202 when printing according to the response curve 220. The controller 210 also is to selectively increase and decrease the print speed 212 to maximize print speed 212 based on long-term energy data 240 corresponding to past print data 242 without exceeding a thermal limit 244 of the power supply 202 when printing according to the response curve 220.

The power supply 202 can include a plurality of rails 203 for providing power. A rail can power a different portion of the printer system 200, such as a group of dies and/or print heads. For example, a print head (not shown) of the printer system 200 can include a plurality of dies (units of print head nozzles) that are powered by two rails 203 and arranged in a staggered formation, so that the paper path passes a first group of dies corresponding to a first power supply rail, and then a second group of dies (slightly offset from the first group of dies) corresponding to a second power supply rail. In an example, the power supply 202 can provide equal voltage output on the plurality of rails 203, such as 33 Volts on two or three rails. Rails may be protected by fuse(s), such as a 2.5 Amp fuse used on each rail. The use of a plurality of rails enables a given printer to consume well beyond 2.5 Amps total, while ensuring that each rail is independently fuse protected.

The response curve 220 can include a plurality of slopes 221, and can be affected by damping 224, short-term energy data 230, second derivative 226, and long-term energy data 240. The second derivative 226 can be used by the controller 210 to identify issue(s) associated with the plurality of slopes 221. For example, the controller 210 can monitor the second derivative 226 to identify that printing has stopped oscillating and somewhat normalized on a given speed within a small regime, indicating that the printer system 200 is likely printing the same print job repeatedly. Accordingly, the controller 210 can determine how fast the print speed 212 can be increased to handle the repeating job, and set the print speed 212 to that value (i.e., exit closed-loop mode and use direct control) if and/or until the second derivative 226 increases to a significant value again (i.e., exceeds a second derivative threshold). If the print data indicates dynamic data, and/or the second derivative 226 becomes significant enough to indicate the potential for oscillations, the controller 210 can revert back to a closed loop mode. The controller 210 can thereby maximize the print speed 212 based on the response curve 220, without overflowing the power curve 222. Such an approach, whereby the controller 210 can switch modes during a print job based on whether the print job is repetitive over time as indicated by the second derivative, further enhances performance (while improving acoustics/user experience and avoiding oscillations) and maximizes print speed 212, while avoiding exceeding the capabilities of the power supply 202.

The second derivative 226 can be obtained from a PID controller and can vary, depending on a given print job. In an example, the controller 210 can identify whether a value for the second derivative 226 has fallen below a threshold (or has fallen within a control window), and correspondingly identify that a transient period has passed such that the printer system 200 has reached a steady state condition. In an example, the controller 210 can perform such identification based on whether the absolute value of the second derivative is less than sigma, epsilon double prime, and so on. An example threshold or window for values of the second derivative of a given printer system 200 can be determined through experimentation, e.g., using exemplar printouts to identify suitable values that avoid undesirable oscillation and associated acoustic or other behavior issues, which can vary from printer to printer. Avoiding oscillation also has the potential to improve PQ, by avoiding a need to address ink dot effects associated with changing print speed 212 due to oscillation (constant speed is desirable in terms of maintaining highest print quality).

Thus, the controller 210 can monitor the second derivative 226 to determine when to switch between closed-loop control and open-loop control (e.g., switching to a direct-solve control) on the fly, e.g., when the print data is repetitive. This switching can be used at portions of the response curve 220 associated with a thermal regime, when the printer system 200 has been printing for a longer time period and thermal effects are important factors in maximizing print speed 212 without exceeding the thermal limit 244.

The printer system 200 does not rely on open loopiclosed loop regimes exclusively, because the printer system 200 can be in a steady-state closed loop mode, where printing has reached a steady state while still in a closed-loop solution, enabling improved control compared to a direct solution alone. When printing is no longer steady state, the controller 210 can switch back into a transient closed-loop mode.

The controller 210 can adjust print speed 212 asymmetrically, e.g., by increasing the print speed 212 more conservatively than decreasing the print speed 212. If the controller 210 identifies a need to slow down (e.g., based on a change in the response curve 220 in view of the current speed), the controller can adjust quickly. By contrast, if the controller identifies a need to speed up to maximize print speed 212, the controller can increase the print speed 212 cautiously. Such an approach avoids frequent speed changes, e.g., if the printer system 200 were to speed up and immediately slow down again. Thus, speeds for the printer system 200 can exhibit rise and fall times being asymmetrical, such that the fall times would be short/fast, and the rise times would be progressive/slow. The controller 210 can combine and/or exclude various features of damping 224, second derivative 226, and other features used in controlling print speed 212.

Figure 3:
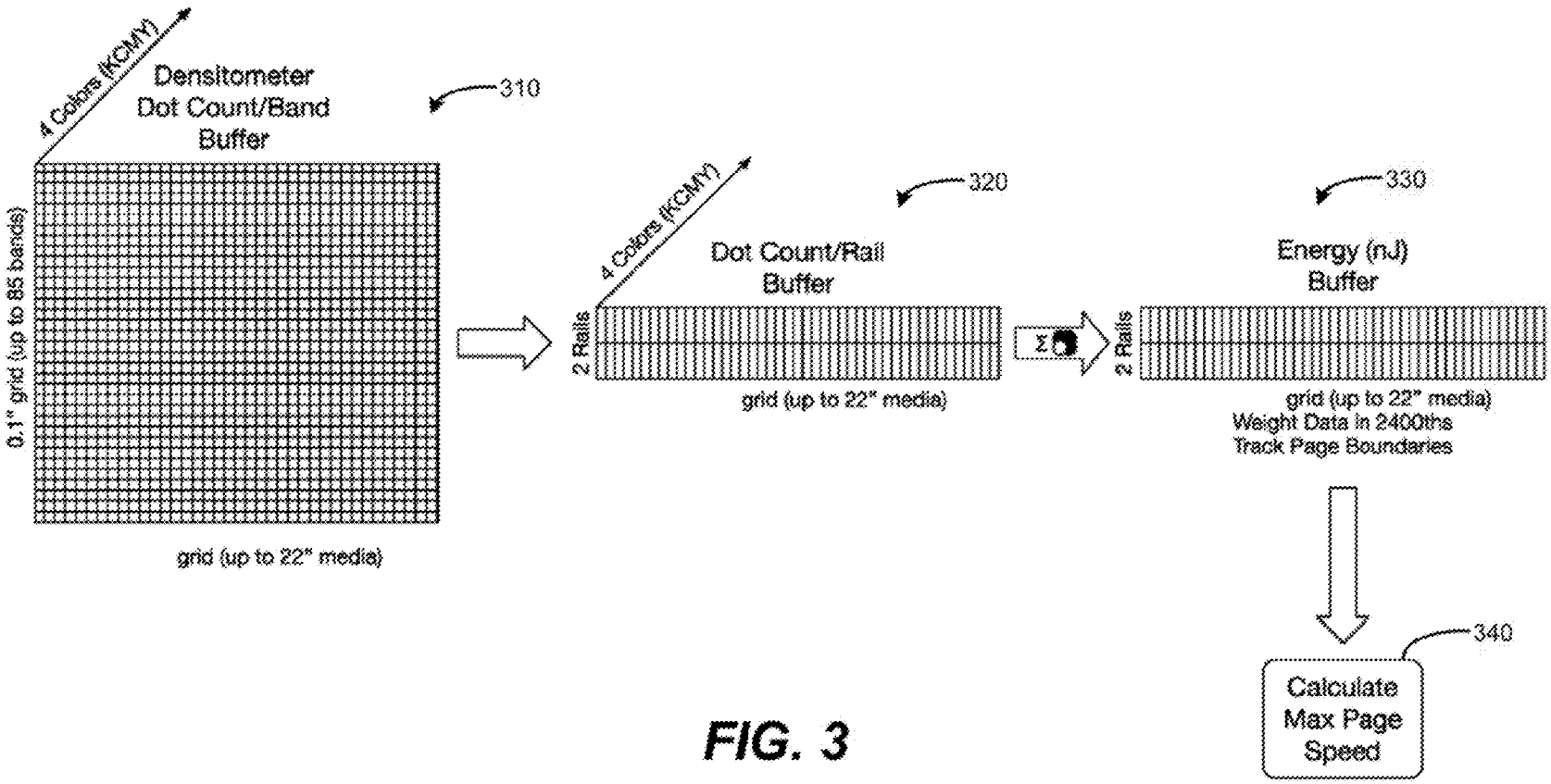
FIG. 3 is a diagram illustrating the conversion of print data to energy data according to an example.

FIG. 3 is a diagram illustrating the conversion of print data from total data 310 to rail data 320, to energy data 330, according to an example. The examples described herein can use the energy data 330 to calculate the maximum print speed per block 340.

A densitometer can identify print data 310, and the controller can divide the print data 310 into two rails of data 320. The information is shown broken up into a grid, such as grids of 0.1 inch or 0.05 (where the increment is programmable and can vary for other example grids). The print data 310 represents an image where a box is converted into 64×64 pixels, which can be varied based on a given printer's characteristics such as dots per inch (DPI). The print data 310 can be summed into the two illustrated channels of data 320, which are four channels deep in color data (black, cyan, magenta, yellow). The data 320 is multiplied by the energy per color and summed to remove the color information, to provide the energy data 330. The energy data 330 can then be used by a controller to develop a response curve and control the print speed.

Figure 4:
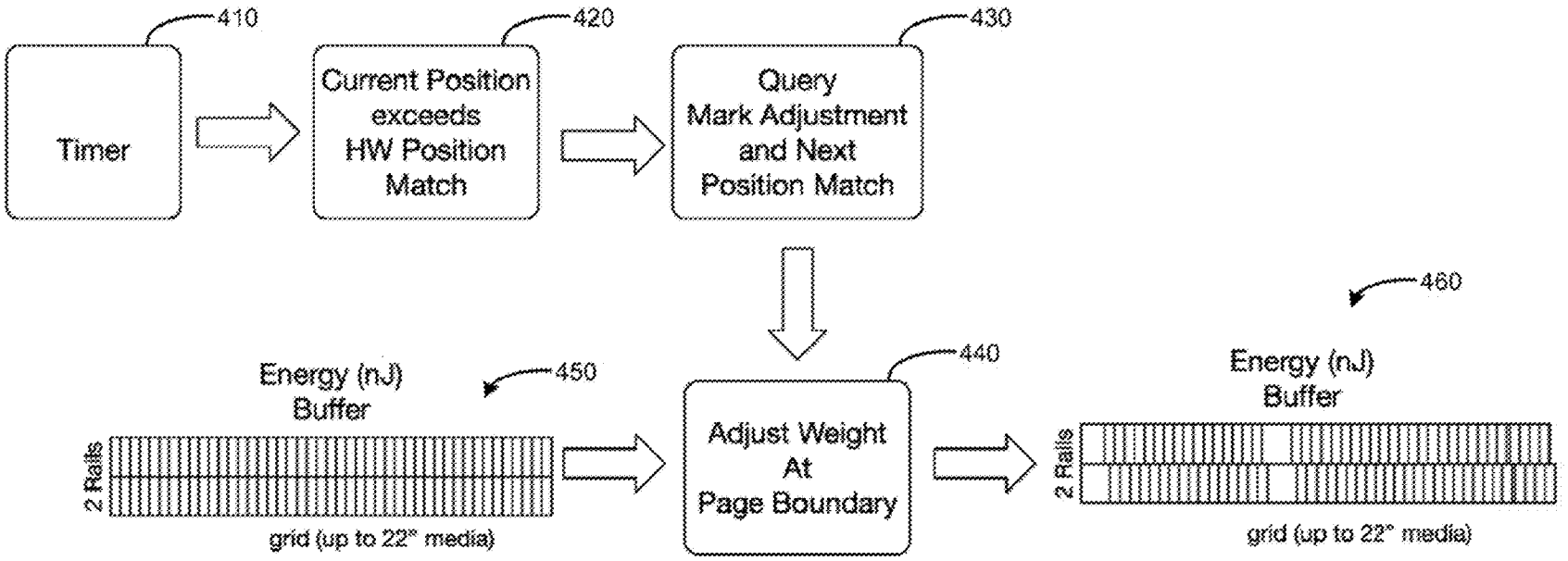
FIG. 4 is a diagram illustrating the adjustment of energy data with offsets according to an example.

FIG. 4 is a diagram illustrating the adjustment of energy data 450 with offsets according to an example. A timer 410 can be used to identify whether current position 420 exceeds a hardware position match, and a controller can query 430 whether a mark adjustment and a next position match each other. Weight 440 can then be adjusted at page boundaries, by taking the energy data 450 and inserting offsets to provide the offset energy data 460.

A printer system can thus perform energy data mark correction. Roll-fed printer media can be marked with timing marks/fiducials to enable the printer system to track the printer media movement and ensure that the ink is being printed in the right places. The controller can adjust 440 boundaries to align positions of print data/images to ensure that the densitometer data matches what is actually measured by the printer device, e.g., by inserting and removing spaces in the energy buffer data 460.

The data 460 is shown slightly offset between the two rails, which corresponds to a staggered offset arrangement of print heads divided between the two rails. The white gaps represent a boundary where image data is spaced farther apart, e.g., based on gaps/margins between images even if printed on continuous media.

Figure 5:
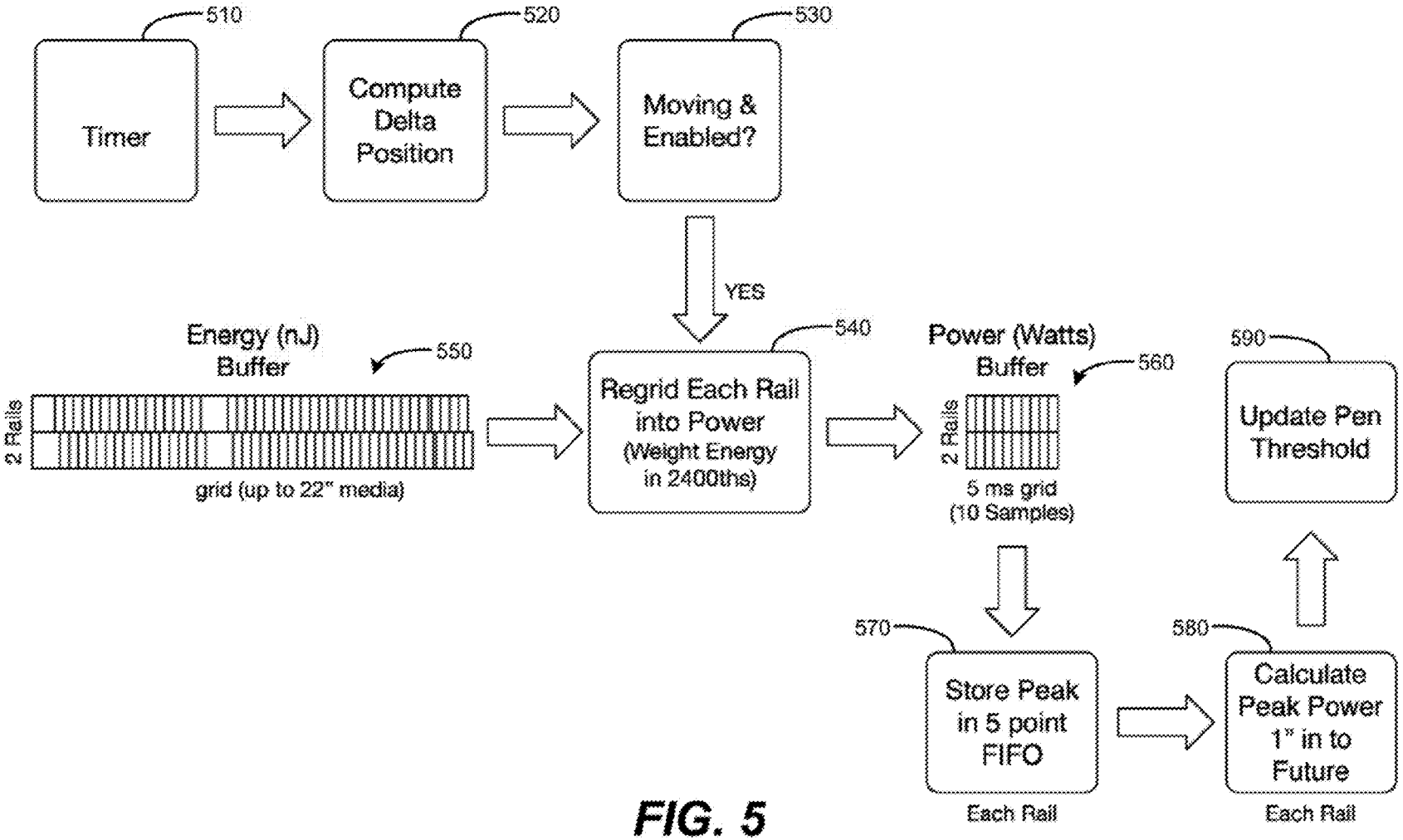
FIG. 5 is a diagram illustrating the regridding of energy data to power data according to an example.

FIG. 5 is a diagram illustrating the regridding of energy data to power data according to an example. A timer 510 is used to compute delta position 520. A check for whether the printer is moving and enabled 530 is performed, and if so, the energy data 550 is regridded 540 to power data 560. A peak of the power data 560 is stored in a memory 570, illustrated as a 5-point first in, first out (FIFO) memory. The peak power is calculated 580 into the future, and pen threshold is updated 590.

The regridding 540 can use energy per unit length from the energy data 550, and based on the printer speed, measure power as a function of energy per unit time. To avoid aliasing issues from arbitrarily multiplying by print speed, interpolation may be used by the controller to some extent to ensure that the response curve stays the same size (with the same energy) when regridding to smooth out the results, avoiding issues from the densitometers limited resolution and potentially discontinuous increments. Thus, the regridding 540 takes some energy per unit length from the energy data 550 and converts it into power (energy per unit time) data 560, which depends on the print speed. In an example, each illustrated box in the data represents a 5 millisecond (ms) slice of the grid for every 15 ms at 20 Hertz (Hz) according to the timer 510.

A peak value of the power is stored 570 in a 5 point FIFO, based on the controller monitoring a maximum power among the grid of samples in the power data 560. The controller can consider a time into the future, and the past (as illustrated, one inch of printer swath) which can be used as a threshold 590.

Figure 6:
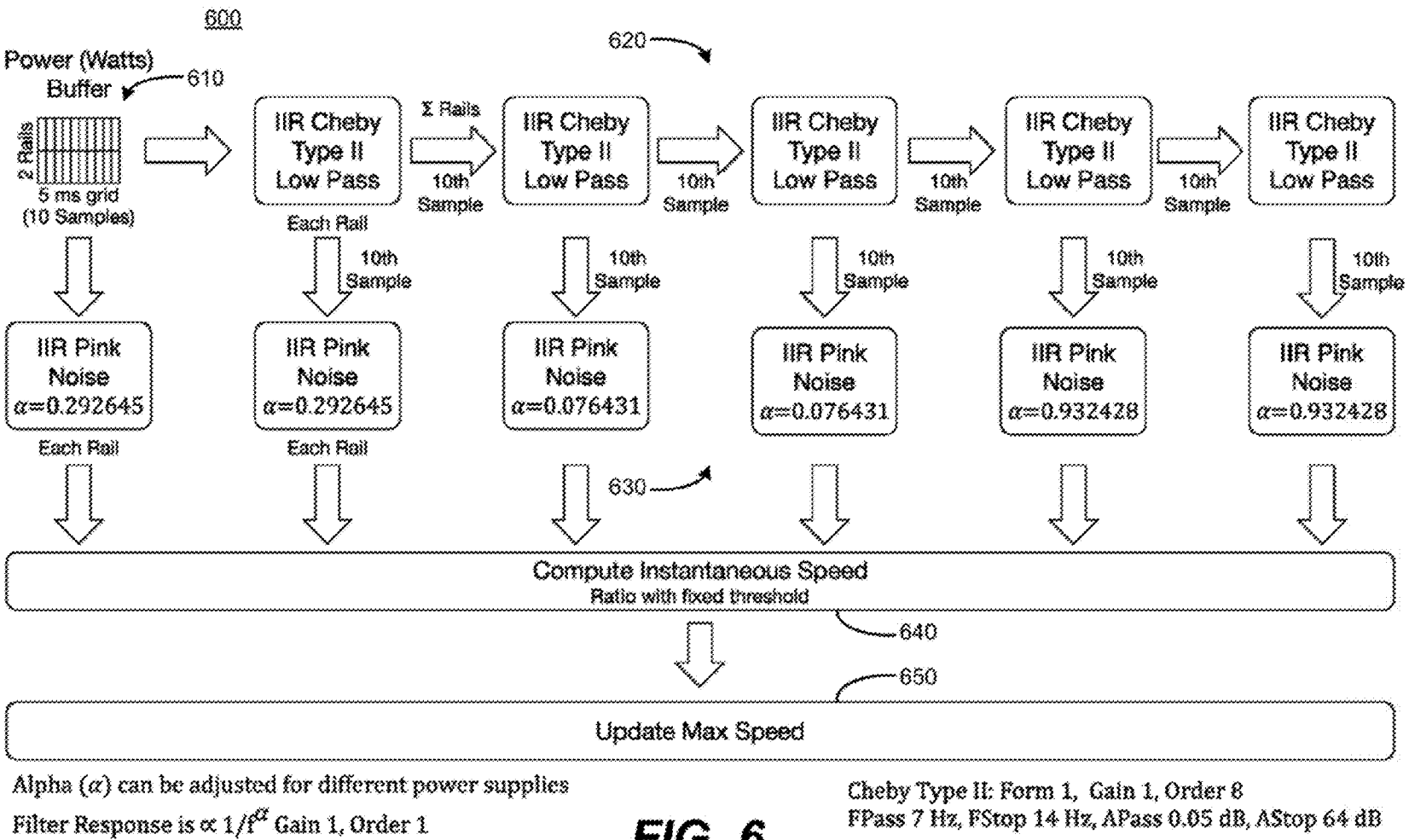
FIG. 6 is a diagram illustrating the use of power data to determine an instantaneous speed according to an example.

FIG. 6 is a diagram illustrating the use of power data 610 to determine an instantaneous speed 640 according to an example. A controller can iteratively apply a cascade plurality of digital filters 620, 630 to the accumulated plurality of power information samples of the power data 610. A first portion 620 of the plurality of digital filters is to satisfy the Nyquist criterion to prevent aliasing of the sample data prior to decimation. A second portion 630 of the plurality of digital filters is to scale the decimated sample data to track the power curve. The current speed 640 can be used to update the maximum speed 650.

The cascaded digital filter system 600 of FIG. 6 can be used to fit an arbitrary power/response curve, by creating an arbitrarily shaped passband and dividing the filtering into many cascaded portions. The filter system 600 can be implemented on an integer-based processor, without a need for floating point support, while preserving signal stability and avoiding rounding errors.

Multiple filter system 600 may be used. For example, a filter system 600 may correspond to a rail of a power supply, where the power supply includes a plurality of rails. Multiple filters can work in parallel to divide a problem into solvable smaller problems, by feeding the output of one filter into the next while performing signal processing to ensure that filters of short-term data do not feed output into filters for the long-term data, and vice versa. The power data 610 is shown with ten samples, which can be divided up to create a curve. The data can be used as error terms to perform a PID loop using the filters 620, 630 to update the max speed 650.

The filters 620, 630 are illustrated as infinite impulse response (IIR) Chebyshev and pink noise filters, although other types of filters may be used such as Bessel, butterworth, elliptic, and the like. The cascading filters 620, 630 are Nyquist limited to prevent rounding errors, by sampling information at a frequency that is over twice the frequency of the needed output. The first filters 620 (Chebychev filters) are to filter out the higher frequencies before decimating, to avoid aliasing. As illustrated, every $10^{th}$ sample is used, and the phase of the sampling can be adjusted to maximize the phase response of the system. Thus, the cascading plurality of digital filters 620, 630 meet the Nyquist criterion for decimation. The second filters 630 are illustrated as pink noise filters, to adapt the filtered power to the power supply curve. The IIR pink noise filters are applied to the decimated data, to scale it to the desired power curve, to reduce the high frequency components to fit the power curve. Six pink noise filter blocks are shown, such that two different filters can be applied to each segment/slope of the three-segment sloping chart shown in FIG. 9 (five Chebyshev filters are shown, having a similar correspondence, although the first Chebyshev filter is not needed on the first segment and so is omitted). Initially, the first two pink noise filters (and the first Chebyshev filter) are applied to each of a plurality of rails individually, corresponding to the first segment of the chart in FIG. 9. The subsequent four pink noise and four Chebyshev filters are applied by summing the rails together. Thus, the cascade plurality of digital filters, satisfying the Nyquist criterion to prevent aliasing prior to decimation, enable the filter system 600 to have the output of each aliasing Chebyshev filter be fed into a corresponding infinite impulse response (IIR) pink noise filter, with a response curve designed to closely fit a power supply curve. The filter system 600 enables a controller to identify long-term energy data based on past print data to avoid exceeding a thermal limit of a power supply.

Figure 7:
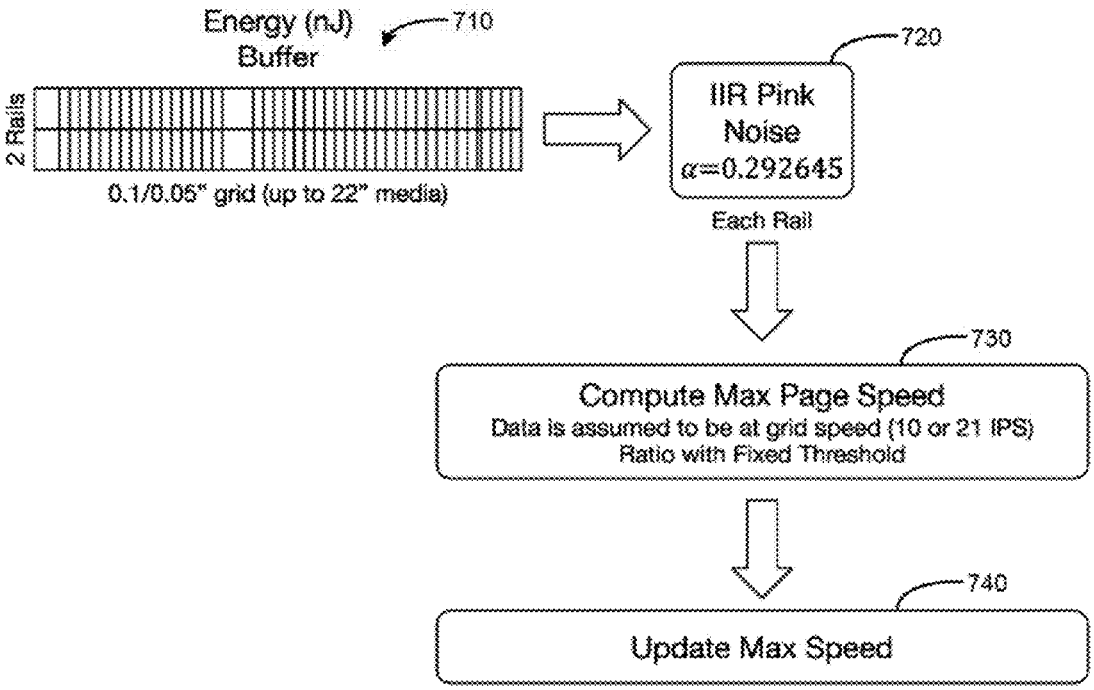
FIG. 7 is a diagram illustrating the use of energy data to determine a maximum page speed according to an example.

FIG. 7 is a diagram illustrating the use of energy data 710 to determine a maximum page speed 730 according to an example. The energy data 710 is fed to a pink noise filter 720, and used to compute the max page speed 730, which is then used to update a maximum speed 740.

A single pink noise filter can be used in this regime, corresponding to a short time scale regarding present and future print data, to identify whether a peak power output of a power supply has been exceeded in the short term based on present and future print data (e.g., 1" into the future). A controller can identify a fixed printer speed, such as 10 IPS or 20 IPS depending on printer mode and/or data spacing, and ratio that print speed by whatever print speed the printer is actually using, to identify how much power consumption is predicted. The maximum printer speed can then be updated accordingly. This enables the printer to predict for future needs based on printer data. As set forth above regarding the filters of FIG. 6, the filter 720 illustrated in FIG. 7 can similarly be chosen from a variety of filters that can provide a response that tracks/matches the power curve.

Figure 8:
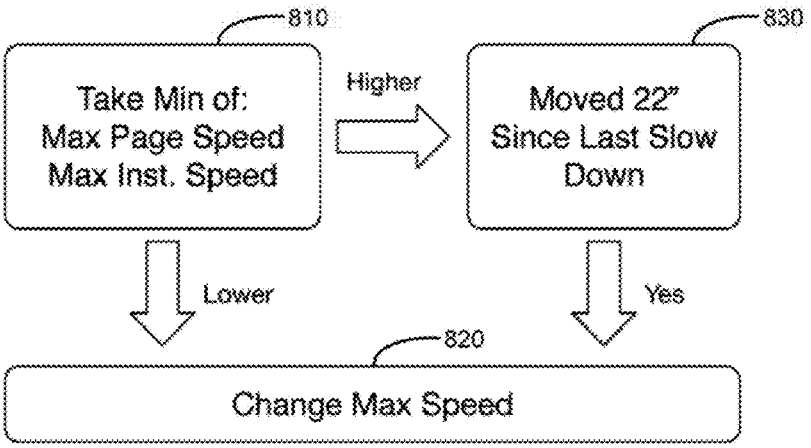
FIG. 8 is a diagram illustrating the updating of maximum speed based on a maximum page speed and a maximum instantaneous speed according to an example.

FIG. 8 is a diagram illustrating the updating of maximum speed 820 based on a maximum page speed and a maximum instantaneous speed 810 according to an example. In block 810, a controller is to take the minimum of the two computed speeds as set forth above in FIGS. 6 and 7. If, in block 830, the printer speed hasn't sped up in the last 22" (or other suitable increment), then the print speed can be increased at block 820. However, if at block 810 there is a need to decrease the print speed, the print speed can be decreased at block 820. FIG. 8 illustrates the asymmetrical aspect of how speed increases can be more conservative (e.g., checking whether there has been movement at block 830 before increasing print speed) and speed decreased can be relatively less conservative. The asymmetrical aspect can provide a beneficial user experience by avoiding speeding up and slowing down repetitively.

Figure 9:
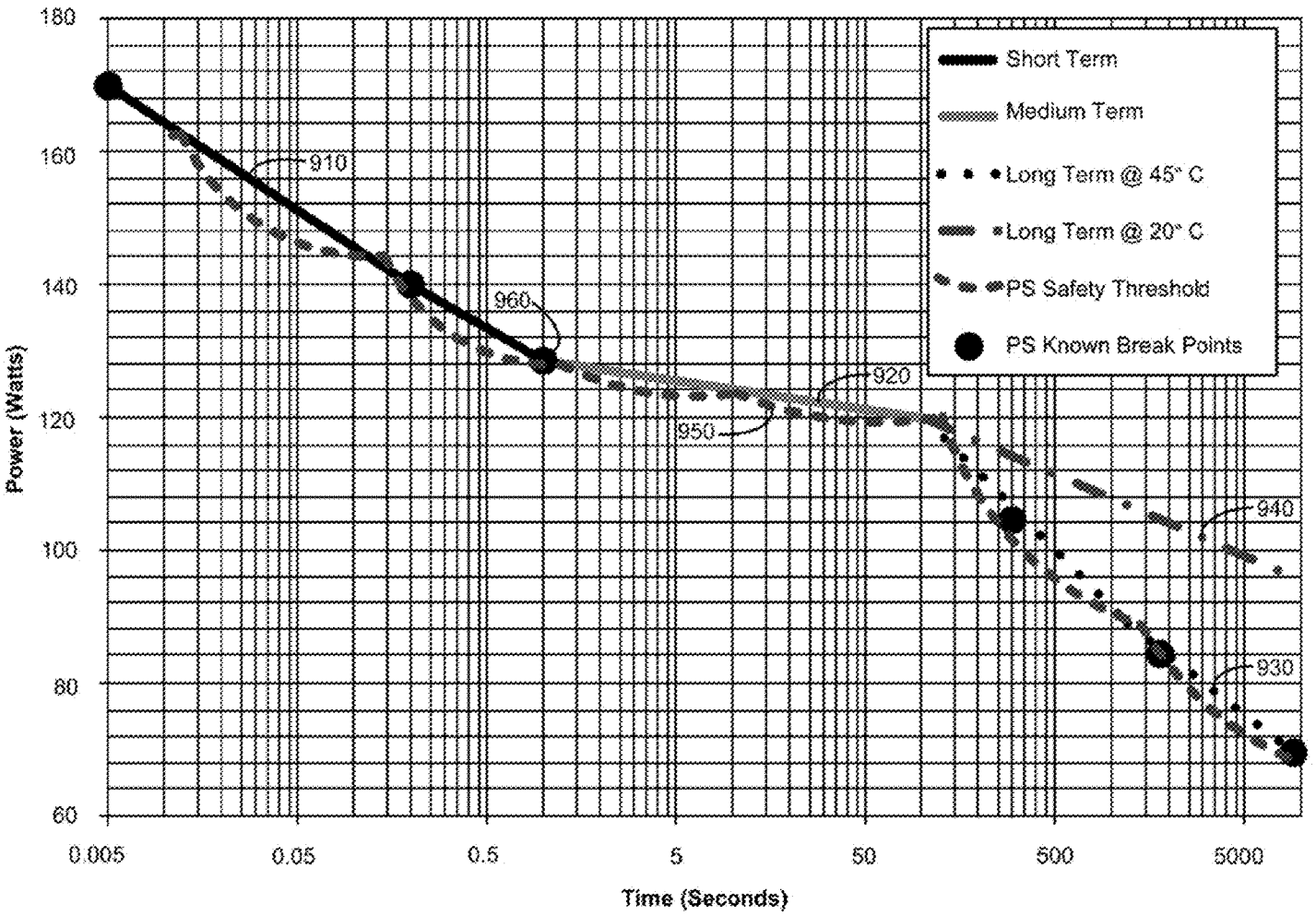
FIG. 9 is a chart illustrating short term, medium term, and long term power data, as well as power supply safety threshold data, according to an example.

FIG. 9 is a chart illustrating short term 910, medium term 920, and long term 930, 940 power data, as well as power supply safety threshold data 950, according to an example. Known break points 960 of the power supply are also illustrated. The short term, medium term, and long term power data form a power curve, and the power supply safety threshold data forms a response curve.

The power curve 910-940 can be determined by a controller based on the known break points 960, and the response curve 950 can be formed by a series of filters (e.g., FIGS. 6 and 7) to replicate and track over time the power supply capacity as represented by the power curve 910-940. A power supply can be associated with known capabilities, such as being capable of delivering, e.g., 140 W for up to 2 seconds, 105 W for up to 5 minutes, 85 W for 30 minutes, and 70 W indefinitely. The controller can interpolate those known specifications/break points 960, based on the assumption that thermal energy is linear, to achieve the power curve 910-940. Notably, the power curve 910-940 can include discontinuities or changes in slope, including a plurality of different slopes. Based on the expected power curve 910-940, the cascade plurality of filters can be used to create the dynamic response curve 950 to track the power curve 910-940.

The response curve 950 is shown sometimes falling below, and sometimes crossing above, the power curve 910-940. Thus, the response curve 950 can track the power curve 910-940 by staying within range of the power curve 910-940 (e.g., within on the order of ten percent or less). In an example, the response curve 950 for long-term printing can remain within 1% of the long-term power curve 930, 940, because the speed of the printer can be quantized from 20 to 19 IPS. In another example, for the short term power curve 910, the response curve 950 can remain within on the order of 5%. The controller attempts to cause the response curve 950 to track the power curve 910-940, but is allowed to violate exceed' the power curve 910-940 (but typically only for a short period of time). The controller can use a modified PID approach (e.g., $PIDD^2$) having different regimes corresponding to the different slopes of the power curve 910-940. The controller can determine, for a given point, a difference between the power curve 910-940 and the response curve 950, and use the difference to create an error term which is used as feedback on the print speed control. The power curve 910-940 can be obtained by pre-characterizing a given power supply, based on design specification to deliver a particular curve for that power supply. Thus, a different power supply would potentially result in a different appearance for the power curve 910-940, including different break points and/or slopes/regimes.

In the short term 910, which is shown extending up to on the order of one second in time, each of a plurality of power rails may be considered individually. Thus, each rail of a power supply may be characterized and print speed can be maximized to saturate the power curve for each rail while avoiding exceeding a peak power output for each rail in the short term. After the short term 910 (times of on the order of one second and greater), the rails are treated together/combined, to maximize print speed for the combined power curve of the rails while avoiding exceeding thermal issues for the power supply in the long term.

Two different long term power curves 930, 940 are shown representing the different effects that ambient temperatures can have on the power curve. Similarly, a power supply can use cooling to affect the power curve, such as a fan for active cooling to increase the power that the power supply could sustain over time before running into the thermal limit. Generally, the longer the print supply is used for printing, the lower the power curve 910-940 drops due to thermal heating over time. The response curve 950 is able to track the power curve 910-940 over time, even when the power supply is used to print continuously for hours or more.

Thus, the response curve 950 protects the power supply while maximizing print speeds across multiple regimes, including short-term, long-term, and a middle regime transitioning between the short-term and long-term (as represented by the plurality of different slopes in FIG. 9). The first regime 910 corresponds to on the order of one second, the middle regime 920 corresponds to on the order of one minute, and the long-term regime 930, 940 corresponds to on the order of hours. Although the long-term regime 930, 940 of the power curve is illustrated having two different slopes depending on ambient temperature, the controller is using a response curve 950 that tracks the more conservative long-term power curve 930 corresponding to a hotter ambient temperature. Thus, the controller can adapt the response curve 950 to track a power curve 910-940 and maximize print speed based on ambient temperatures that the power supply is expected to experience. This enables even faster print speeds where the controller can take into consideration the ambient temperatures (and/or when the power supply can be subjected to active cooling). The controller can compensate for such changes and adjust the power curve and/or response curve accordingly.

Although a plurality of regimes/slopes are illustrated in FIG. 9, in alternate examples, the power curve and response curve can be based on a single slope/regime, or shapes based on curves, logarithmic scales, or other patterns. Examples can perform sampling in real time for the present times to avoid exceeding a peak power output, and use history to extrapolate a long-term portion of the thermal curve for the power supply, as well as use data to predict the future response curve. Thus, the response curve is not limited to a per-page adjustment granularity, and can adjust in much finer intra-page increments (e.g., half-inch increments and smaller). This enables a printer to speed up when print output is light, and slow down when heavy print areas are encountered, making such changes even during a print swath. Furthermore, the various power curves and response curves are enabled based on digital filtering that can operate on the relatively limited (e.g., integer based) computing resources available on a given printer, while substantially fitting the response curve to the power curve to a high degree of accuracy with minimal error between the curves (e.g., within 10% or less) over extended periods of time spanning orders of magnitude differences in time.

Figure 10:
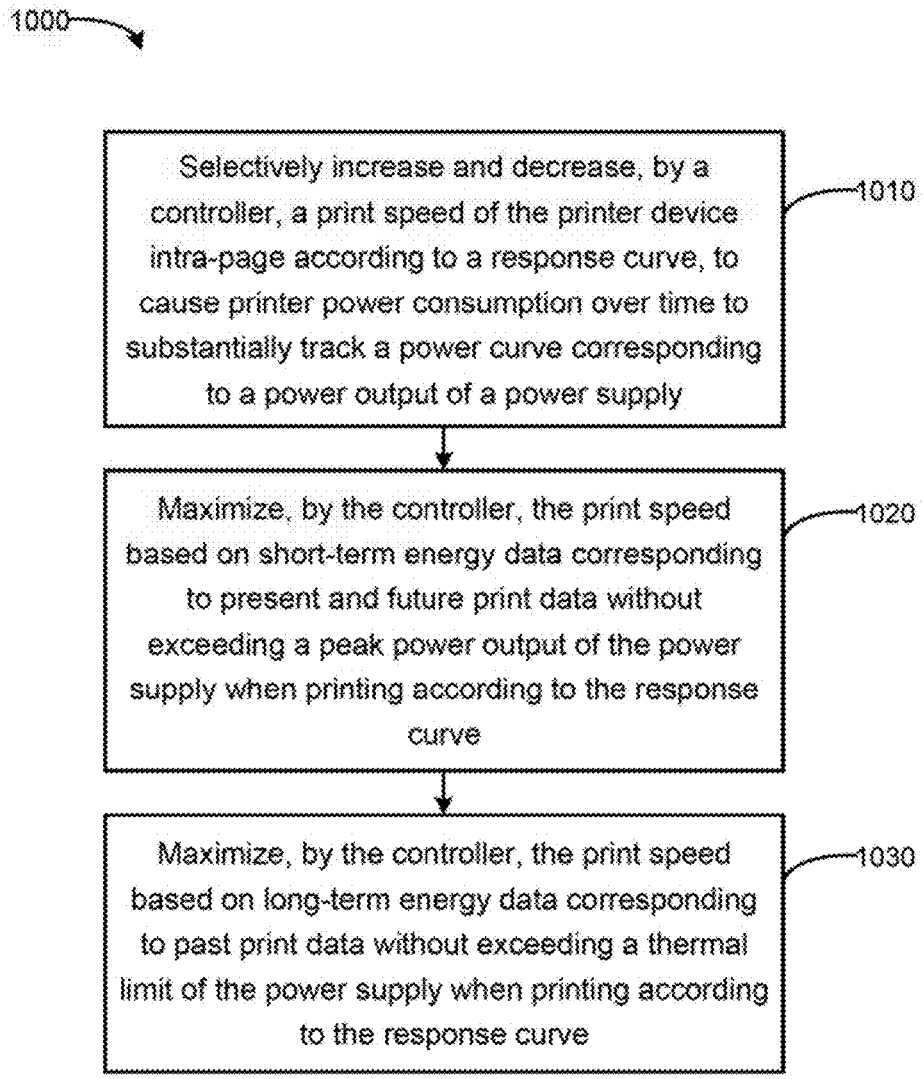
FIG. 10 is a flow chart based on updating print speed according to an example.
Figure 11:
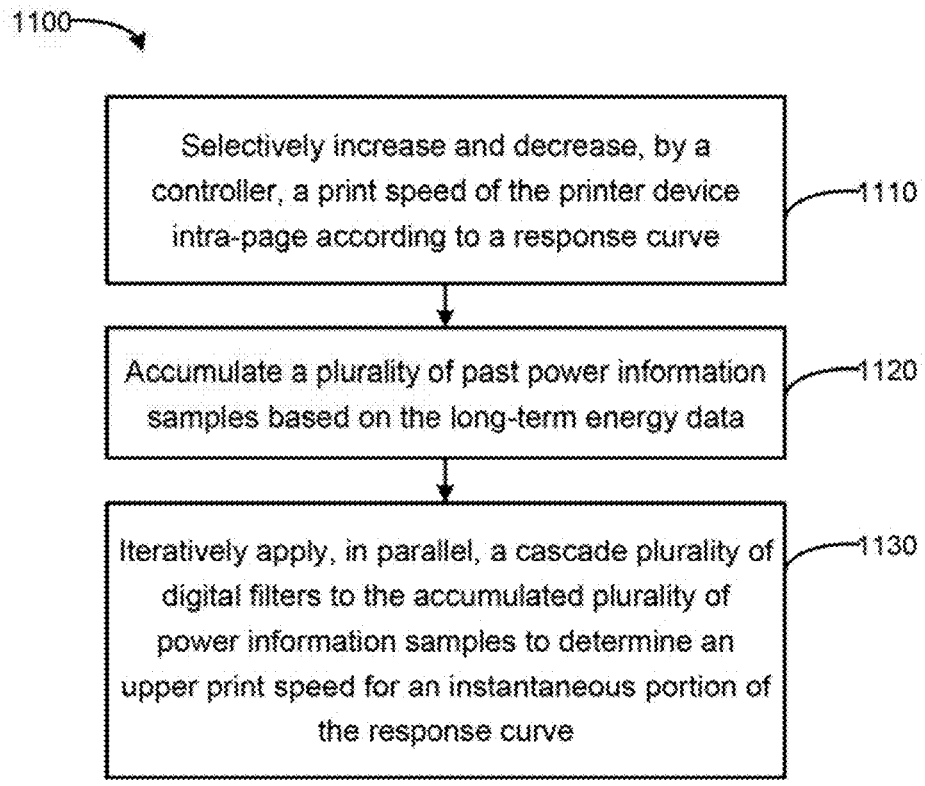
FIG. 11 is a flow chart based on adjusting print speed according to an example.

Referring to FIGS. 10 and 11, flow diagrams are illustrated in accordance with various examples of the present disclosure. The flow diagrams represent processes that may be utilized in conjunction with various systems and devices as discussed with reference to the preceding figures. While illustrated in a particular order, the disclosure is not intended to be so limited. Rather, it is expressly contemplated that various processes may occur in different orders and/or simultaneously with other processes than those illustrated.

FIG. 10 is a flow chart based on updating print speed according to an example. In block 1010, a controller is to selectively increase and decrease a print speed of the printer device intra-page according to a response curve, to cause printer power consumption over time to substantially track a power curve corresponding to a power output of a power supply. For example, the controller can generate a power curve of the power supply based on interpolating specified break points of the power supply, and use a plurality of cascading filters to generate the response curve. In block 1020, the controller is to update the print speed based on short-term energy data corresponding to present and future print data to avoid exceeding a peak power output of the power supply when printing according to the response curve. For example, the power curve can include a short-term and medium-term regime, according to which the print speed can be adjusted to cause the response curve to remain within on the order of 10% of the power curve. In block 1030, the controller is to update the print speed based on long-term energy data corresponding to past print data to avoid exceeding a thermal limit of the power supply when printing according to the response curve. For example, the power curve can include a long-term regime, according to which the print speed can be adjusted to cause the response curve to remain within on the order of 5% of the power curve.

FIG. 11 is a flow chart based on adjusting print speed according to an example. In block 1110, a controller is to selectively increase and decrease a print speed of the printer device intra-page according to a response curve. For example, the print speed can be adjusted according to increments of a half-inch and finer, even during a print swath. In block 1120, a plurality of past power information samples are accumulated based on the long-term energy data. For example, the controller can store past energy data for a sliding window of time. In block 1130, a cascading plurality of digital filters are iteratively applied, in parallel, to the accumulated plurality of power information samples to determine an upper print speed for an instantaneous portion of the response curve. For example, a first group of infinite impulse response (IIR) chebyshev filters can be used to satisfy the Nyquist criterion to prevent aliasing, and a second group of IIR pink noise filters can be used to scale decimated sample data from the first group of filters to track the power curve.

Examples provided herein may be implemented in hardware, software, or a combination of both. Example systems can include a processor and memory resources for executing instructions stored in a tangible non-transitory medium (e.g., volatile memory, non-volatile memory, and/or computer readable media). Non-transitory computer-readable medium can be tangible and have computer-readable instructions stored thereon that are executable by a processor to implement examples according to the present disclosure.

An example system (e.g., including a controller of a printing device) can include and/or receive a tangible non-transitory computer-readable medium storing a set of computer-readable instructions (e.g., software, firmware, etc.) to execute the methods described above and below in the claims. For example, a system can execute instructions to direct a print speed engine to adjust print speed, wherein the print speed engine includes any combination of hardware and/or software to execute the instructions described herein. As used herein, the processor can include one or a plurality of processors such as in a parallel processing system. The memory can include memory addressable by the processor for execution of computer readable instructions. The computer readable medium can include volatile and/or non-volatile memory such as a random access memory ("RAM"), magnetic memory such as a hard disk, floppy disk, and/or tape memory, a solid state drive ("SSD"), flash memory, phase change memory, and so on.

What is claimed is:

1. A printer device comprising:

a controller to selectively increase and decrease a print speed of the printer device intra-page according to a response curve, to cause printer power consumption over time to substantially track a power curve corresponding to a power output of a power supply;

wherein the controller is to maximize print speed, based on short-term energy data corresponding to present and future print data and long-term energy data corresponding to past print data, without exceeding a peak power output and a thermal limit of the power supply when printing according to the response curve; and wherein the controller is to selectively increase and decrease the print speed according to the response curve to cause the printer power consumption over time to remain within on the order of ten percent of the power curve to substantially track the power curve.

2. The printer device of claim 1, wherein the controller is to selectively increase and decrease the print speed based on an enhanced proportional-integral-derivative (PID) approach including adding damping to the response curve to address undershooting of the power curve, and identifying whether an absolute value of a second derivative is less than a stability threshold indicating that control has stabilized at a steady-state.

3. The printer device of claim 2, wherein, in response to identifying the second derivative stabilizing at steady-state, the controller is to switch from a PID closed-loop control mode to a direct solution steady-state closed-loop control mode.

4. The printer device of claim 2, wherein, in response to identifying the second derivative exhibiting a transient response, the controller is to switch from a direct solution steady-state closed-loop control mode to a PID closed-loop control mode.

5. The printer device of claim 1, wherein the controller is to accumulate a plurality of past power information samples based on the long-term energy data, and determine an upper print speed for an instantaneous portion of the response curve based on a PID loop approach to iteratively apply a cascade plurality of digital filters to the accumulated plurality of power information samples.

6. The printer device of claim 1, wherein a first portion of the plurality of digital filters is to satisfy the Nyquist criterion to prevent aliasing of the sample data prior to decimation, and a second portion of the plurality of digital filters is to scale the decimated sample data to track the power curve.

7. The printer device of claim 1, wherein the controller is to identify short-term energy data corresponding to a page, and determine an upper print speed for a portion of the response curve corresponding to the page, based on applying a digital filter designed to exhibit response that tracks the power curve to the short-term energy data, and applying a ratio corresponding to a current print speed.

8. The printer device of claim 1, wherein the controller is to selectively increase and decrease the print speed based on intra-page time increments corresponding to a sweep along a page-wide printing swath of the printer device less than a standard page length for that printer device.

9. A printer system comprising:

a power supply associated with a power output that vanes over time according to performance of the power supply; and a controller to generate a power curve based on the power output over time, and selectively increase and decrease a print speed of the printer system intra-page according to a response curve, to cause printer power consumption over time to substantially track the power curve;

wherein the controller is to selectively increase and decrease the print speed to maximize print speed based on short-term energy data corresponding to present and future print data without exceeding a peak power output of the power supply when printing according to the response curve;

wherein the controller is to selectively increase and decrease the print speed to maximize print speed based on long-term energy data corresponding to past print data without exceeding a thermal limit of the power supply when printing according to the response curve; and wherein the controller is to generate the power curve over time based on interpolating power output for portions of the power curve between known power output break points.

10. The system of claim 9, wherein the controller is to generate the response curve including a first slope corresponding to the present and future print data, a second slope corresponding to a transition between the present and future print data and the past print data, and a third slope corresponding to the past print data.

11. The system of claim 10, wherein the power supply includes a plurality of rails to output power for printing; and wherein, for time periods corresponding to up to the peak power output, the controller is to generate a first slope of the response curve based on providing power to the plurality of rails individually, wherein for time periods corresponding to greater than the peak power output, the controller is to generate the response curve as a combination of the plurality of rails.

12. A method to operate a printer device, comprising:

selectively increasing and decreasing, by a controller, a print speed of the printer device intra-page according to a response curve, to cause printer power consumption over time to substantially track a power curve corresponding to a power output of a power supply;

maximizing, by the controller, the print speed based on short-term energy data corresponding to present and future print data without exceeding a peak power output of the power supply when printing according to the response curve;

maximizing, by the controller, the print speed based on long-term energy data corresponding to past print data without exceeding a thermal limit of the power supply when printing according to the response curve; and accumulating a plurality of past power information samples based on the long-term energy data, and iteratively applying, in parallel, a cascade plurality of digital filters to the accumulated plurality of power information samples to determine an upper print speed for an instantaneous portion of the response curve.

* * * * *